US008297807B1

(12) United States Patent
Chen

(10) Patent No.: US 8,297,807 B1
(45) Date of Patent: Oct. 30, 2012

(54) ELEVATION ADJUSTABLE WINDOW CANDLE

(76) Inventor: Ching-Chao Chen, Hsinchu (TW)

( * ) Notice: Subject to any disclaimer, the term of this patent is extended or adjusted under 35 U.S.C. 154(b) by 117 days.

(21) Appl. No.: 13/069,477

(22) Filed: Mar. 23, 2011

(51) Int. Cl.
*F21V 21/14* (2006.01)

(52) U.S. Cl. ..... 362/393; 362/392; 362/569; 431/297

(58) Field of Classification Search ..... 362/161, 362/202, 392, 393, 565, 569, 653, 810; 431/297; D26/9–23
See application file for complete search history.

(56) References Cited

U.S. PATENT DOCUMENTS 3,725,696 A * 4/1973 Morton ..... 362/399
5,193,994 A * 3/1993 Schirneker ..... 431/293
6,270,864 B1 * 8/2001 Weiss ..... 428/18
6,273,710 B1 * 8/2001 Zou ..... 431/290
6,780,007 B1 * 8/2004 Coffin, Sr. ..... 431/297

FOREIGN PATENT DOCUMENTS

GB 2140909 A * 12/1984

* cited by examiner

*Primary Examiner* — Hargobind S Sawhney
(74) *Attorney, Agent, or Firm* — Jackson IPG PLLC

(57) ABSTRACT

An elevation adjustable window candle includes a candlestick having axial sliding grooves axially disposed between stop portions and an inside shoulder therein, a candle shaft having springy retaining blocks equiangularly suspending in the bottom side thereof and respectively axially slidably coupled to the sliding grooves in the candlestick to secure the candle shaft to the candlestick at the desired elevation by means of friction resistance, and a lampshell mounted on the top end of the candle shaft and holding a LED lamp module therein.

9 Claims, 9 Drawing Sheets

ELEVATION ADJUSTABLE WINDOW CANDLE

BACKGROUND OF THE INVENTION

1. Field of the Invention

The present invention relates to window candles and more particularly, to an elevation adjustable window candle, which allows the user to adjust the elevation of the candle shaft relative to the candlestick and, which has the characteristics of simple structure and easy of elevational adjustment.

2. Description of the Related Art

A window candle has been a traditional practice in many cultures. Placing a candle in the window symbolizes the warmth and security of the family hearth and signals loyalty to family members and loved ones. Nowadays, many LED lamp type window candles have been created. A LED lamp type window candle generally comprises a base, a candlestick supported on the base, a candle shaft supported on the candlestick, and a lampshell supported on the candle shaft and a LED module mounted inside the lampshell and controllable to emit light through the lampshell. A conventional LED lamp type window candle does not allow adjustment of the elevation of the candle shaft, limiting the application.

SUMMARY OF THE INVENTION

The present invention has been accomplished under the circumstances in view. It is therefore the main object of the present invention to provide an elevation adjustable window candle, which allows adjustment of the elevation of the candle shaft relative to the candlestick conveniently.

It is another object of the present invention to provide an elevation adjustable window candle, which has a simple structure, facilitating installation, lowering the manufacturing cost and saving much labor and time in installation.

To achieve these and other objects of the present invention, an elevation adjustable window candle includes a candle stick, a candle shaft and a lamp shell. The candlestick comprises a receiving hole axially downwardly extending from the topmost edge thereof to a predetermined depth, a plurality of sliding grooves axially disposed in the receiving hole, a plurality of stop portions disposed in the receiving hole at the top side of the sliding grooves, and at least one positioning member disposed in the receiving hole at the bottom side. The candle shaft is a tubular shaft member comprising a tubular peripheral wall defining therein an axial hole, an inner thread spirally extending along the inner surface of the peripheral wall at the top side, at least one locating slot cut through the peripheral wall at the bottom side for axially slidably coupling to the at least one positioning member of the candlestick, and a plurality of retaining blocks formed of a part of the peripheral wall at the bottom side and respectively coupled to the sliding grooves of the candlestick to vertically adjustably secure the candle shaft to the candlestick at the desired elevation by means of friction resistance. The lampshell is threaded into the inner thread of the candle shaft and adapted for accommodating a LED lamp module comprising a circuit board and at least one LED installed in the circuit board.

DETAILED DESCRIPTION OF THE INVENTION

Referring to FIGS. 1~5, an elevation adjustable window candle in accordance with a first embodiment of the present invention is shown comprising a candlestick 1, a candle shaft 2 and a lampshell 3.

Figure 1:
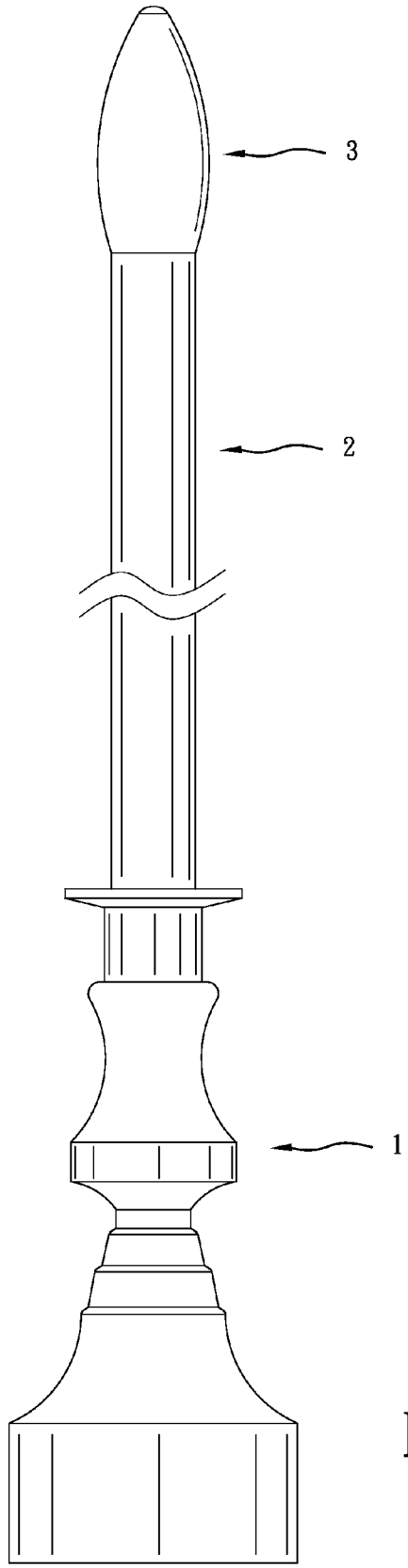
FIG. 1 is a plain view of an elevation adjustable window candle in accordance with a first embodiment of the present invention.
Figure 2:
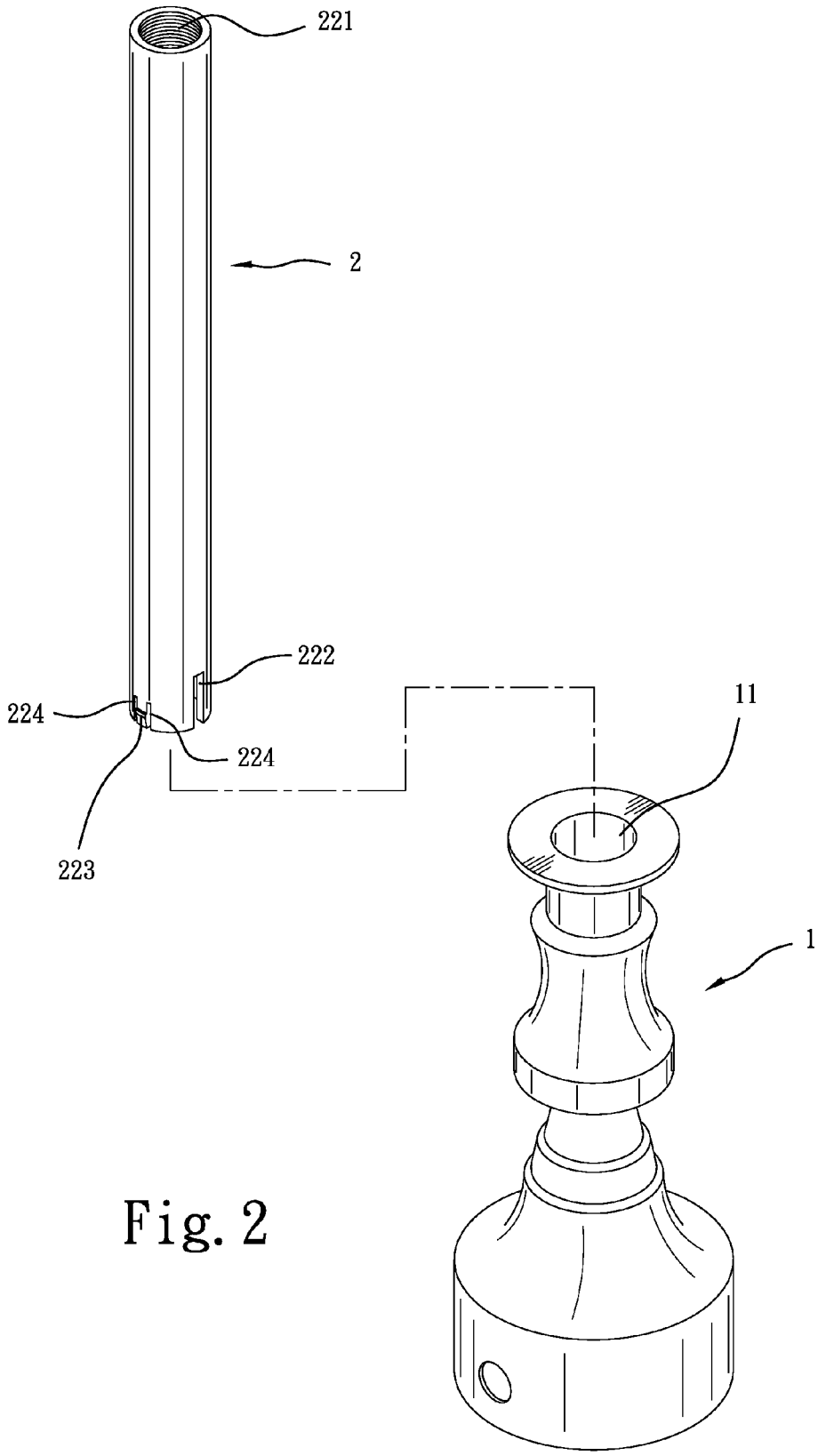
FIG. 2 is an exploded view of the elevation adjustable window candle in accordance with the first embodiment of the present invention (the lamp shell excluded).
Figure 3:
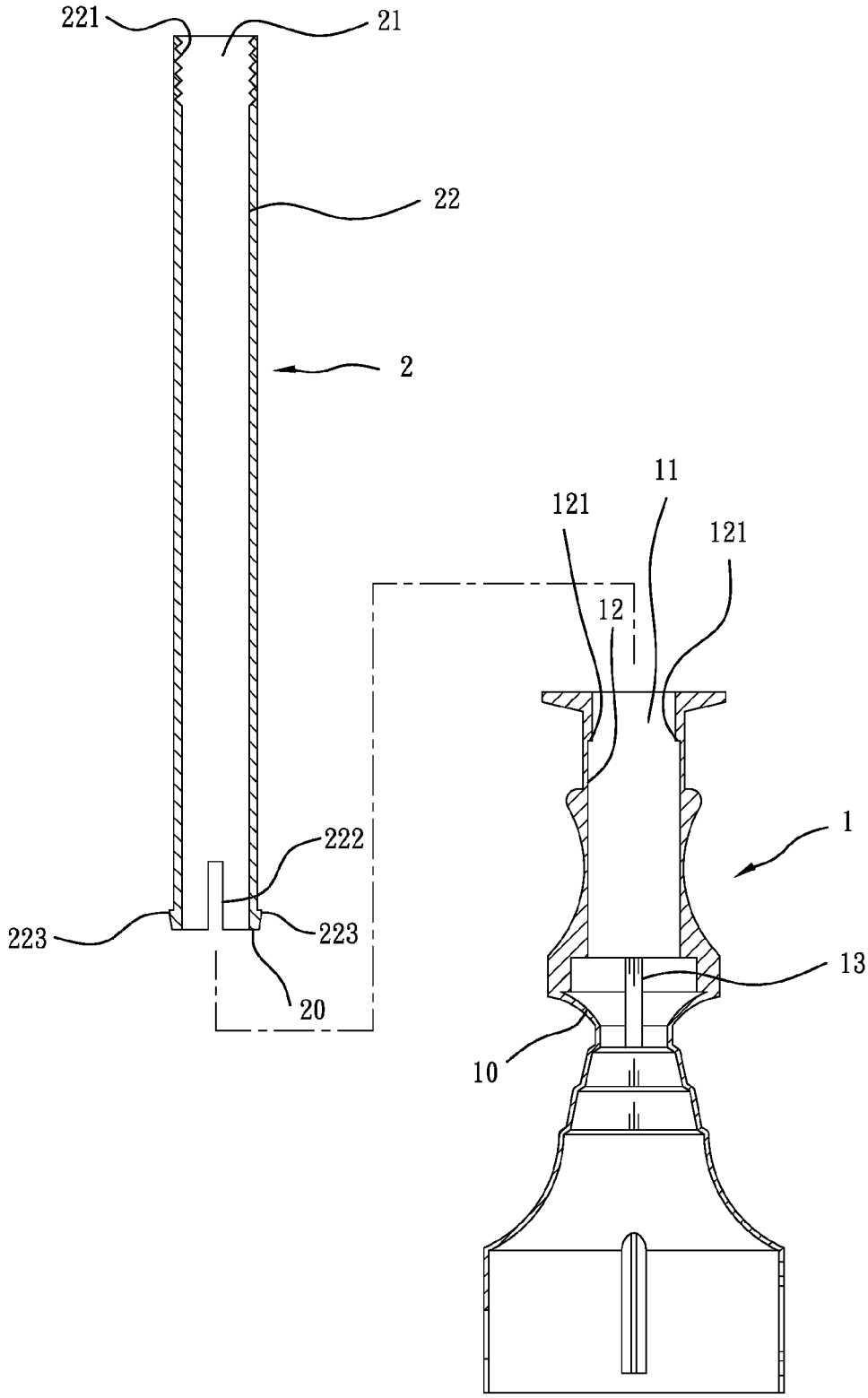
FIG. 3 is a sectional side view of FIG. 2.
Figure 4:
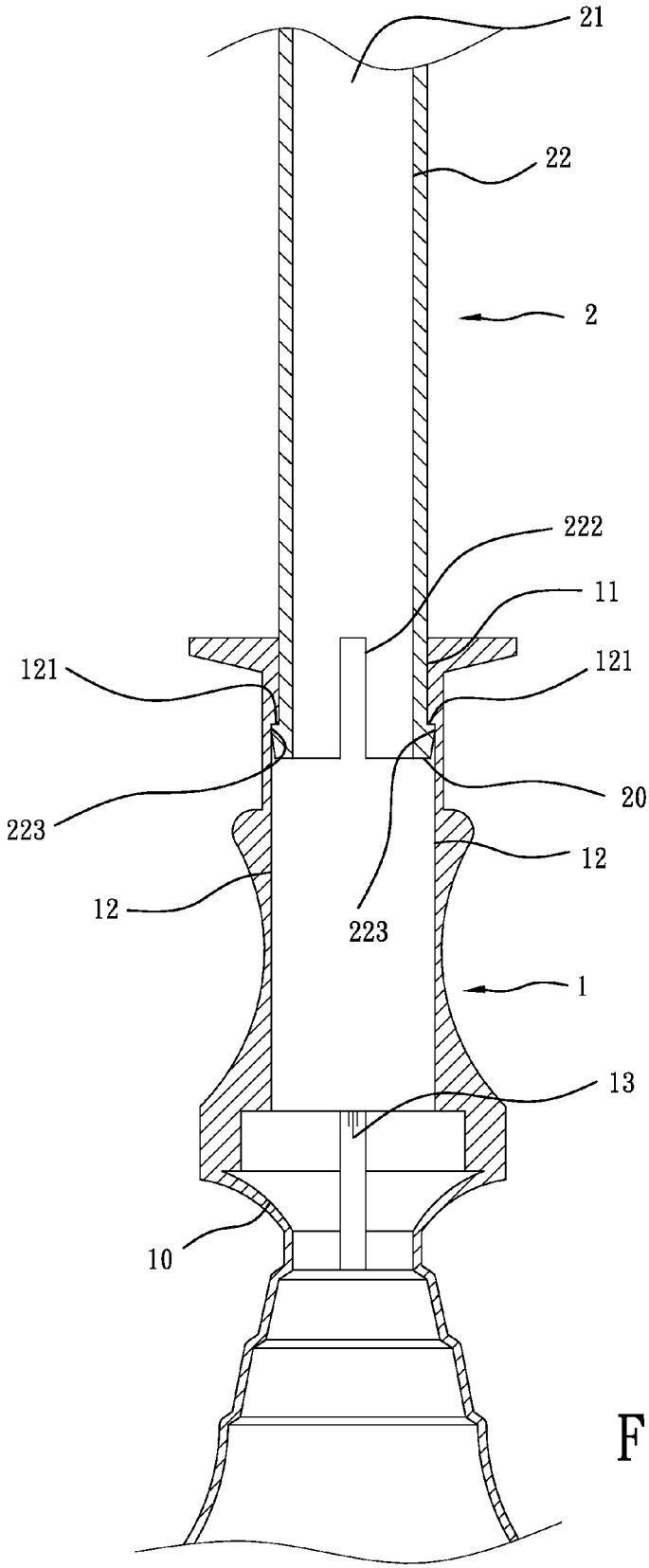
FIG. 4 is a sectional view of a part of the first embodiment of the present invention, illustrating the candle shaft positioned in the upper limit position.
Figure 5:
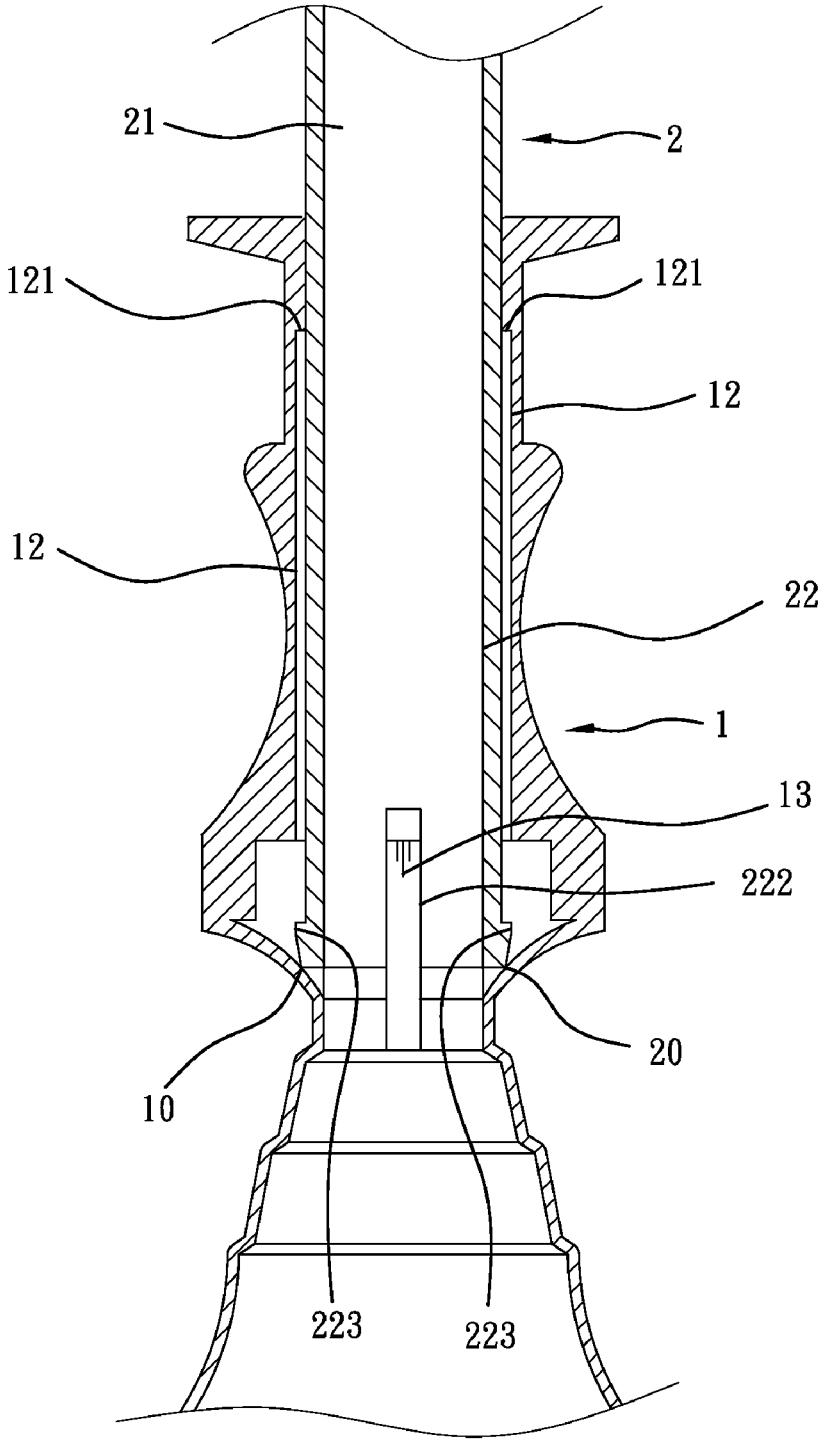
FIG. 5 is a sectional view of a part of the first embodiment of the present invention, illustrating the candle shaft positioned in the lower limit position.
Figure 6:
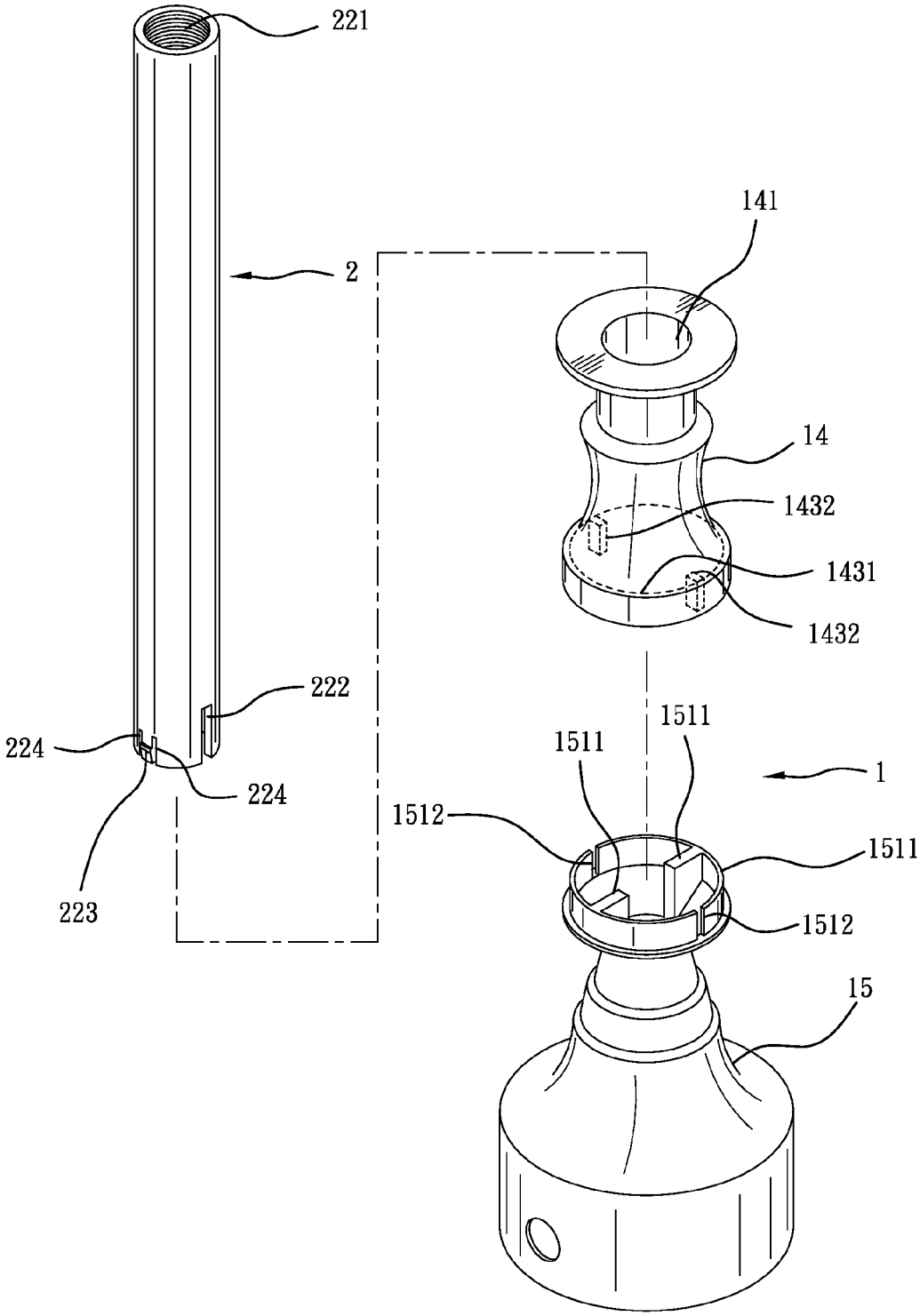
FIG. 6 is an exploded view of an elevation adjustable window candle in accordance with a second embodiment of the present invention (the lamp shell excluded).

The candlestick 1 comprises a receiving hole 11 axially downwardly extending from the topmost edge thereof to a predetermined depth, a plurality of sliding grooves 12 axially disposed in the receiving hole 11 (see FIGS. 4 and 5), a plurality of stop portions 121 disposed in the receiving hole 11 at the top side of each of the sliding grooves 12, and at least one positioning block 13 disposed in the receiving hole 11 at a bottom side far from the topmost edge of the candlestick 1 (see FIGS. 3~5).

The candle shaft 2 is a hollow flexible plastic shaft member comprising a tubular peripheral wall 22 defining therein an axial hole 21 (see FIG. 2), an inner thread 221 spirally extending along the inner surface of the peripheral wall 22 at one side, namely, the top side, at least one locating slot 222 cut through the peripheral wall 22 at an opposite side, namely, the bottom side, for axially slidably coupling to the at least one positioning member 13 of the candlestick 1, a plurality of axial crevices 224 cut through the peripheral wall 22 and extending to the bottom side of the peripheral wall 22, and a plurality of retaining blocks 223 formed of a part of the peripheral wall 22 at the bottom side and respectively suspending between each two adjacent axial crevices 224 and respectively coupled to the sliding grooves 12 of the candlestick 1 to vertically adjustably secure the candle shaft 2 to the candlestick 1 at the desired elevation (see FIG. 4).

The lampshell 3 is threaded with an externally threaded bottom end thereof into the inner thread 221 of the candle shaft 2 and adapted for accommodating a LED lamp module (not shown), which comprises a circuit board and at least one LED installed in the circuit board, and a cable adapted for electrically connecting the circuit board to an external power supply. As the LED lamp module is of the known art and not within the scope of the invention, no further detailed description in this regard is necessary.

The aforesaid candlestick 1 further comprises an inside shoulder 10 disposed in the receiving hole 11 at the bottom side for stopping against the bottom edge 20 of the candle shaft 2 (see FIGS. 3~5).

Subject to coupling between the retaining blocks 223 of the candle shaft 2 and the sliding grooves 12 of the candlestick 1, the candle shaft 2 can be moved axially up and down relative to the candlestick 1 between the stop portions 121 (see FIG. 4) and the inside shoulder 10 (see FIG. 5) and positioned in any desired elevation. When the candle shaft 2 is lifted to the upper limit position, the retaining blocks 223 of the candle shaft 2 are stopped at the bottom side of the stop portions 121, and therefore the candle shaft 2 is held in the highest position relative to the candlestick 1 (see FIG. 4). When a downward pressure is imparted to the candle shaft 2 relative to the candlestick 1, the retaining blocks 223 of the candle shaft 2 are moved along the sliding grooves 12 of the candlestick 1, and the at least one locating slot 222 is coupled to the at least one positioning block 13 of the candlestick 1 and the candle shaft 2 is held in the lowest position relative to the candlestick 1 with the bottom edge 20 thereof stopped at the inside shoulder 10 of the candlestick 1 (see FIG. 5).

FIGS. 6~9 illustrate an elevation adjustable window candle in accordance with a second embodiment of the present invention. According to this second embodiment, the elevation adjustable window candle comprises a candlestick 1, a candle shaft 2 and a lampshell 3.

The candlestick 1 comprises an upper candlestick component 14 and a lower candlestick component 15. The upper candlestick component 14 comprises an axial hole 141 cut through opposing top and bottom sides thereof, a plurality of sliding grooves 142 axially disposed in the axial hole 141 (see FIGS. 8 and 9), a plurality of stop portions 1421 respectively disposed at the top side of each of the sliding grooves 142 in the axial hole 141, a bottom mounting portion 1431 located on the bottom side thereof (see FIG. 6), a bottom mounting hole 143 defined in the bottom mounting portion 1431 and disposed in communication with the axial hole 141 in a concentric manner and a plurality of locating ribs 1432 protruded from the inside wall of the bottom mounting portion 1431 and equiangularly suspending in the bottom mounting hole 143. The bottom mounting hole 143 has a diameter greater than the axial hole 141. The lower candlestick component 15 comprises a tubular top mounting neck 151 press-fitted into the bottom mounting hole 143 in the bottom mounting portion 1431, a plurality of positioning blocks 1511 radially inwardly protruded from the inside wall of the tubular top mounting neck 151 (see FIGS. 6~8), and a plurality of locating notches 1512 cut through the tubular top mounting neck 151 for receiving the locating ribs 1432 of the upper candlestick component 14. It is to be understood the aforesaid connection structure between the upper candlestick component 14 and the lower candlestick component 15 is simply an exemplar of the invention. Other mounting techniques or fastening means may be selectively used to achieve connection between the upper candlestick component 14 and the lower candlestick component 15.

The candle shaft 2 is a hollow flexible plastic shaft member comprising a tubular peripheral wall 22 defining therein an axial hole 21, an inner thread 221 spirally extending along the inner surface of the peripheral wall 22 at one side, namely, the top side, a plurality of locating slots 222 cut through the peripheral wall 22 at an opposite side, namely, the bottom side, for axially slidably coupling to the positioning blocks 1511 of the lower candlestick component 15 of the candlestick 1, a plurality of axial crevices 224 cut through the peripheral wall 22 and extending to the bottom side of the peripheral wall 22, and a plurality of retaining blocks 223 formed of a part of the peripheral wall 22 at the bottom side and respectively suspending between each two adjacent axial crevices 224 and respectively coupled to the sliding grooves 142 of the upper candlestick component 14 of the candlestick 1 to vertically adjustably secure the candle shaft 2 to the candlestick 1 at the desired elevation.

The lamp shell 3 is threaded with an externally threaded bottom end thereof into the inner thread 221 of the candle shaft 2 and adapted for accommodating a LED lamp module (not shown), which comprises a circuit board and at least one LED installed in the circuit board, and a cable adapted for electrically connecting the circuit board to an external power supply. Alternatively, the LED lamp module to be held in the lamp shell 3 can be equipped with a battery to provide the necessary working voltage. As the LED lamp module is of the known art and not within the scope of the invention, no further detailed description in this regard is necessary.

Figure 7:
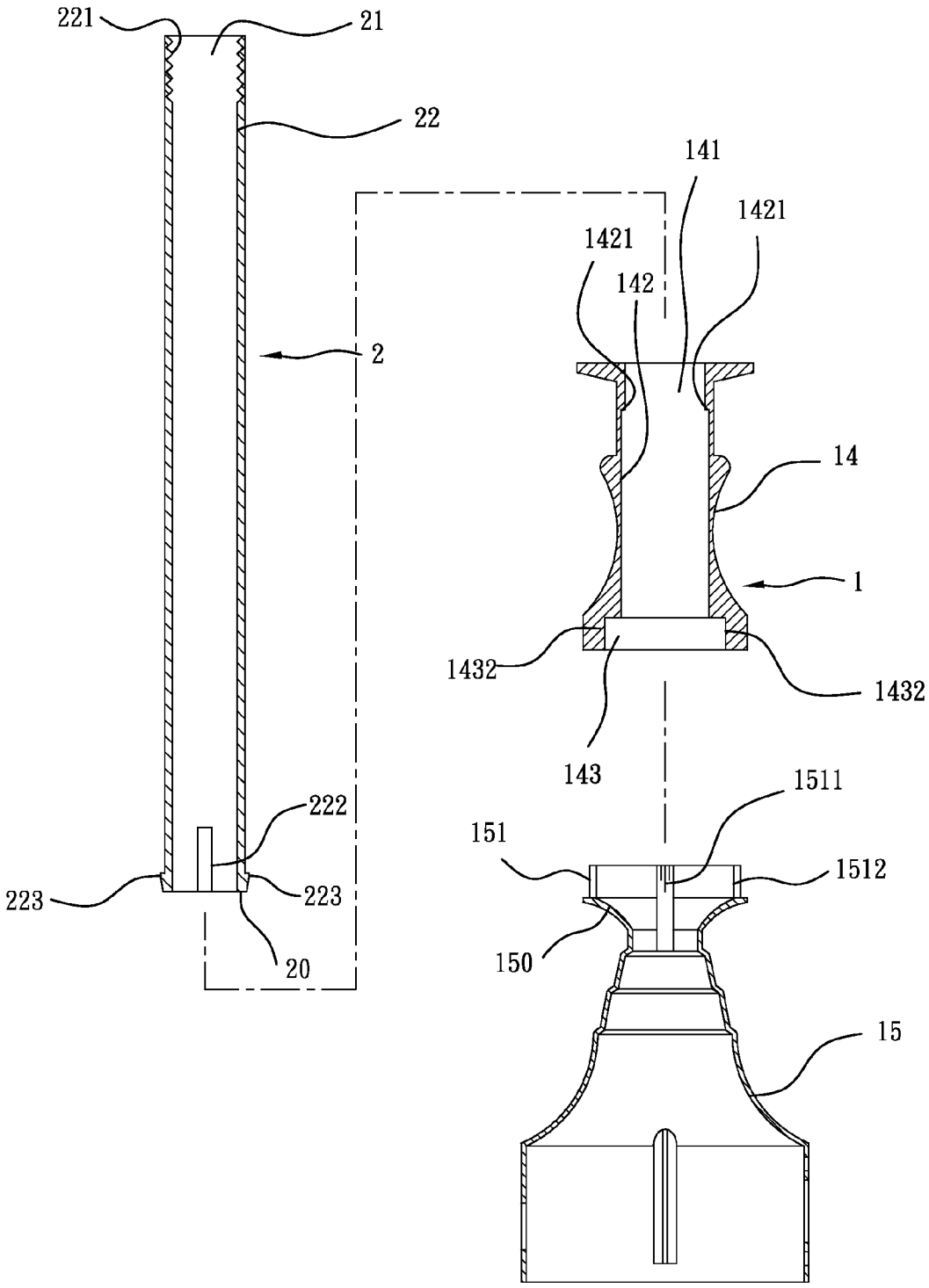
FIG. 7 is a sectional side view of FIG. 6.
Figure 8:
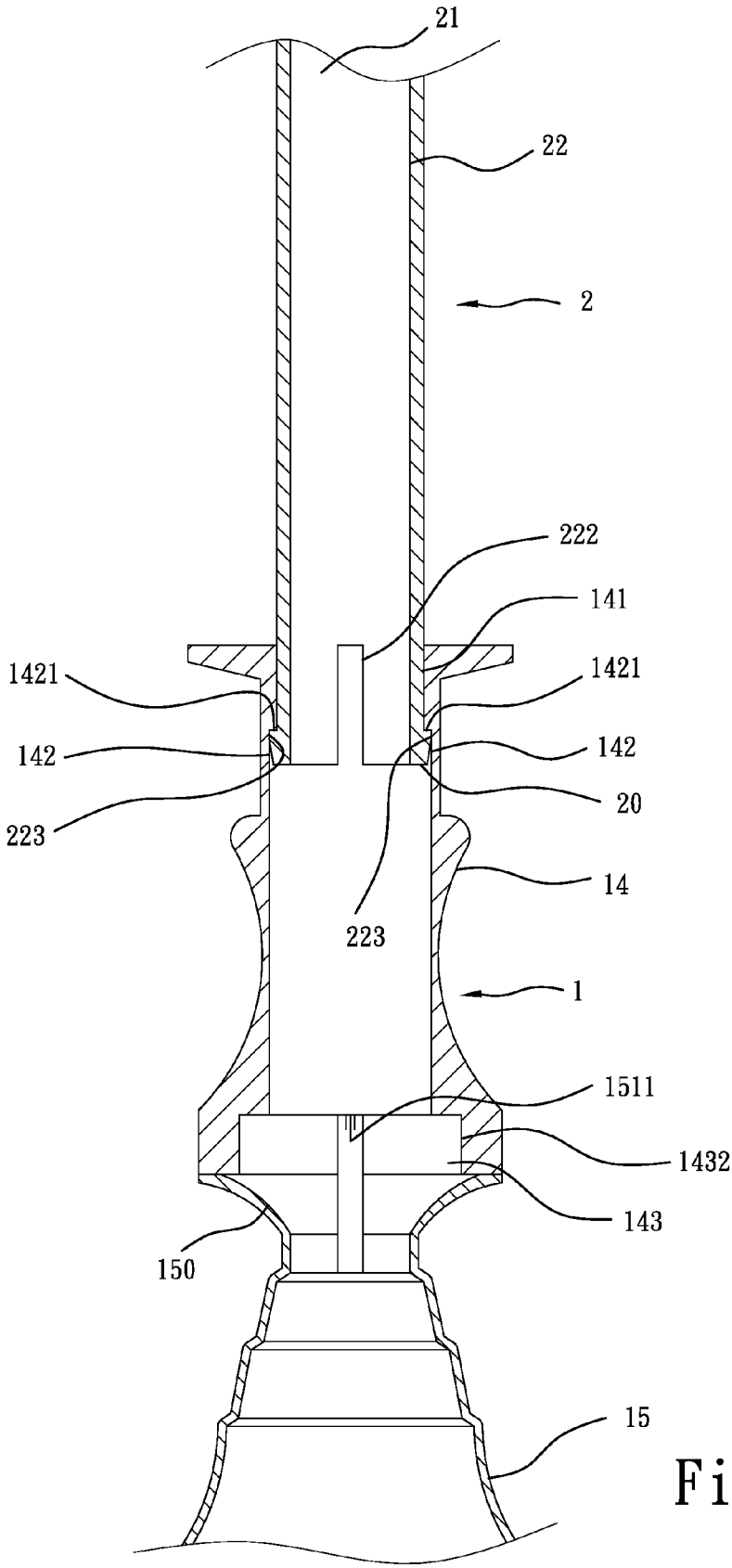
FIG. 8 is a sectional view of a part of the second embodiment of the present invention, illustrating the candle shaft positioned in the upper limit position.
Figure 9:
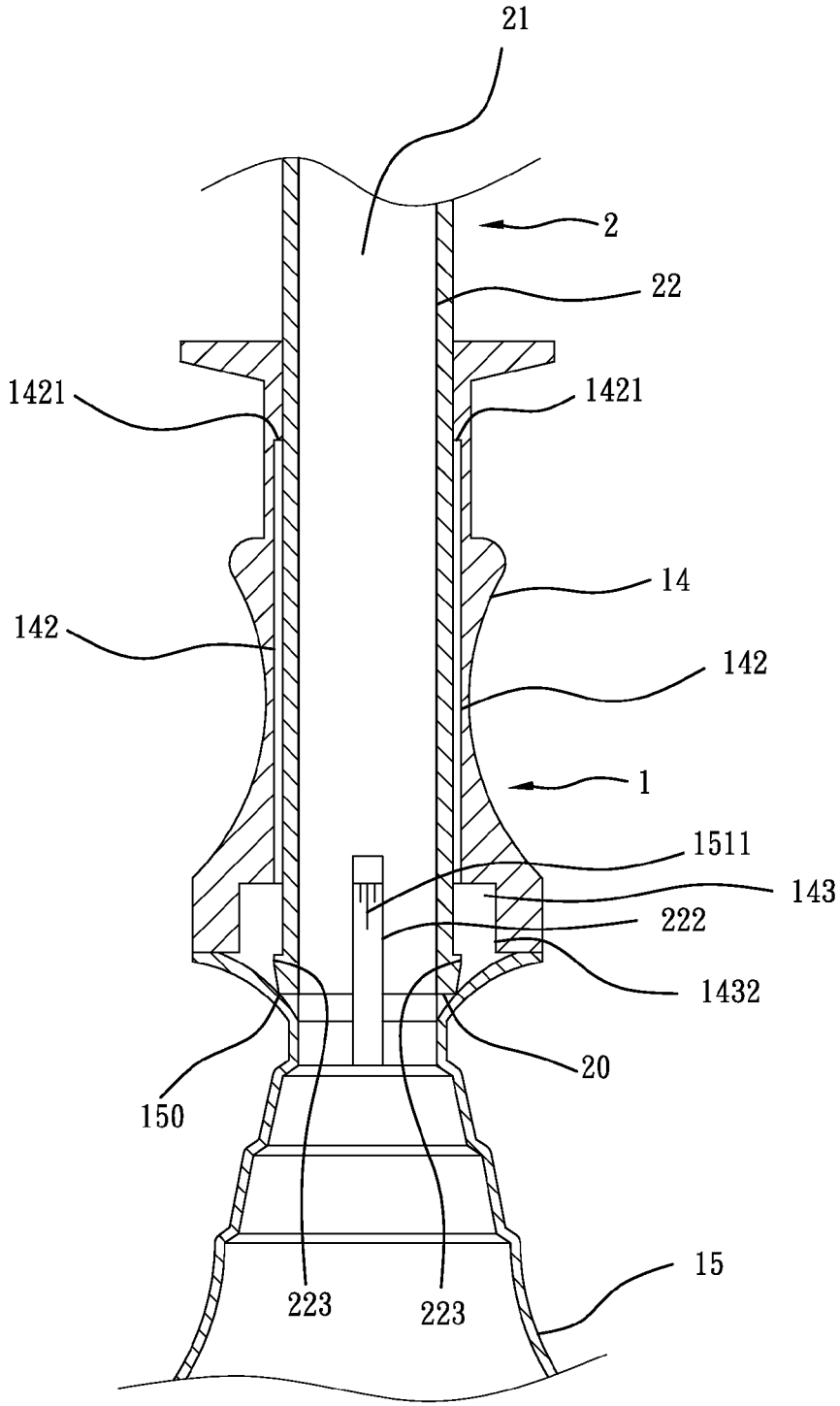
FIG. 9 is a sectional view of a part of the second embodiment of the present invention, illustrating the candle shaft positioned in the lower limit position.

Referring to FIGS. 7~9, the lower candlestick component 15 of the aforesaid candlestick 1 further comprises an inside shoulder 150 protruded from the inside wall of the tubular top mounting neck 151 for stopping against the bottom edge 20 of the candle shaft 2 (see FIGS. 8 and 9).

Subject to coupling between the retaining blocks 223 of the candle shaft 2 and the sliding grooves 142 of the upper candlestick component 14 of the candlestick 1, the candle shaft 2 can be moved axially up and down relative to the candlestick 1 between the stop portions 1421 (see FIG. 8) and the inside shoulder 150 (see FIG. 9) and positioned in any desired elevation. When the candle shaft 2 is lifted to the upper limit position, the retaining blocks 223 of the candle shaft 2 are stopped at the bottom side of the stop portions 1421, and therefore the candle shaft 2 is held in the highest position relative to the candlestick 1 (see FIG. 8). When impart a downward pressure to the candle shaft 2 relative to the candlestick 1, the retaining blocks 223 of the candle shaft 2 are moved along the sliding grooves 142 of the upper candlestick component 14 of the candlestick 1, and the locating slots 222 are coupled to the positioning blocks 1511 of the lower candlestick component 15 of the candlestick 1, and therefore the candle shaft 2 is held in the lowest position relative to the candlestick 1 with the bottom edge 20 thereof stopped at the inside shoulder 150 of the lower candlestick component 15 of the candlestick 1 (see FIG. 9).

In conclusion, the elevation adjustable window candle of the present invention has the following advantages and features:

1. The candle shaft 2 can be conveniently moved upwards or downwards relative to the candlestick 1 and positioned at the desired elevation between an upper limit position and a lower limit position.
2. The elevation adjustable window candle has a simple structure, facilitating installation, lowering the manufacturing cost and saving much labor and time in installation.

What is claimed is:

1. An elevation adjustable window candle, comprising:

a candlestick comprising a receiving hole axially downwardly extending from the topmost edge thereof to a predetermined depth, a plurality of sliding grooves axially disposed in said receiving hole, a plurality of stop portions disposed in said receiving hole at a top side of each of said sliding grooves, and at least one positioning member disposed in said receiving hole at a bottom side far from the topmost edge of said candlestick;

a candle shaft being a tubular shaft member comprising a tubular peripheral wall defining therein an axial hole, an inner thread spirally extending along an inner surface of said peripheral wall at a top side, at least one locating slot cut through said peripheral wall at a bottom side remote from said top side for axially slidably coupling to the at least one positioning member of said candlestick, and a plurality of retaining blocks formed of a part of said peripheral wall at the bottom side and respectively coupled to said sliding grooves of said candlestick to vertically adjustably secure said candle shaft to said candlestick at the desired elevation by means of friction resistance; and a lampshell threaded into the inner thread of said candle shaft and adapted for accommodating a LED lamp module comprising a circuit board and at least one LED installed in said circuit board.

2. The elevation adjustable window candle as claimed in claim 1, wherein said candle shaft further comprises a plurality of axial crevices cut through said peripheral wall and extending to the lowest edge of said peripheral wall at two opposite lateral sides of each of said retaining blocks.

3. The elevation adjustable window candle as claimed in claim 1, wherein said candle shaft is made from a plastic material.

4. The elevation adjustable window candle as claimed in claim 1, wherein said candlestick further comprises an inside shoulder disposed in said receiving hole at the bottom side around said at least one positioning member for stopping against the bottom side of said candle shaft.

5. An elevation adjustable window candle, comprising;

a candlestick comprising an upper candlestick component and a lower candlestick component, said upper candlestick component comprising an axial hole cut through opposing top and bottom sides thereof, a plurality of sliding grooves axially disposed in said axial hole, a plurality of stop portions respectively disposed at a top side of each of said sliding grooves in said axial hole, a bottom mounting portion located on a bottom side thereof, and a bottom mounting hole defined in said bottom mounting portion and disposed in communication with said axial hole in a concentric manner, said bottom mounting hole having a diameter greater than said axial hole, said lower candlestick component comprising a tubular top mounting neck press-fitted into said bottom mounting hole in said bottom mounting portion of said upper candlestick component and a plurality of positioning blocks radially inwardly protruded from an inside wall of said tubular top mounting neck;

a candle shaft being a hollow flexible shaft member comprising a tubular peripheral wall defining therein an axial hole, an inner thread spirally extending along an inner surface of said tubular peripheral wall at a to side thereof, a plurality of locating slots cut through said tubular peripheral wall at a bottom side thereof and adapted for axially slidably coupling to the positioning blocks of said lower candlestick component, and a plurality of retaining blocks formed of a part of said tubular peripheral wall at the bottom side thereof and respectively coupled to the sliding grooves of said upper candlestick component of said candlestick to vertically adjustably secure said candle shaft to said candlestick at the desired elevation by means of friction resistance; and a lamp shell threaded into the inner thread of said candle shaft and adapted for accommodating a LED lamp module comprising a circuit board and at least one LED installed in said circuit board.

6. The elevation adjustable window candle as claimed in claim 5, wherein said candle shaft further comprises a plurality of axial crevices cut through said tubular peripheral wall and extending to the bottom side of said tubular peripheral wall at two opposite lateral sides of each of said retaining blocks.

7. The elevation adjustable window candle as claimed in claim 5, wherein said candle shaft is made from a plastic material.

8. The elevation adjustable window candle as claimed in claim 5, wherein said upper candlestick component further comprises a plurality of locating ribs protruded from the inside wall of said bottom mounting portion and equiangularly suspending in said bottom mounting hole; said lower candlestick component further comprises a plurality of locating notches cut through said tubular top mounting neck and respectively coupled with the locating ribs of said upper candlestick component.

9. The elevation adjustable window candle as claimed in claim 5, wherein said lower candlestick component of said candlestick further comprises an inside shoulder disposed therein and adapted for stopping against the bottom side of said tubular peripheral wall of said candle shaft.

* * * * *